United States Patent [19]

Menschel

[11] 4,245,837

[45] Jan. 20, 1981

[54] OCCUPANT PROPELLED ROTARY CONVEYOR

[76] Inventor: Johannes Menschel, Postfach 1529, D-4190 Kleve, Fed. Rep. of Germany

[21] Appl. No.: 913,863

[22] Filed: Jun. 8, 1978

[30] Foreign Application Priority Data

Jun. 14, 1977 [DE] Fed. Rep. of Germany ..... 2726703

[51] Int. Cl.[3] ..... A63G 1/18

[52] U.S. Cl. ..... 272/33 R

[58] Field of Search ..... 272/33 R, 72, 30, 39, 272/40, 41, 42; 308/216, 217, 235; 74/575, 89, 89.1, 89.11, 89.12, 89.13, 89.14, 89.15, 89.16, 89.17, 89.18, 89.19

[56] References Cited

U.S. PATENT DOCUMENTS

| | | | |
|---|---|---|---|
| 654,154 | 7/1900 | Hile | 272/33 R |
| 858,960 | 7/1907 | Cummings et al. | 272/33 R |
| 927,508 | 7/1909 | Draper | 272/33 R |
| 965,644 | 7/1910 | Mendenhall | 272/33 R |
| 982,310 | 1/1911 | Stewart | 272/33 R |
| 1,068,472 | 7/1913 | Whitman et al. | 272/33 R |
| 1,671,329 | 5/1928 | Swanson | 272/33 R |
| 1,760,811 | 5/1930 | Bustin et al. | 272/33 R |
| 2,560,703 | 7/1951 | Sebel | 272/33 R |
| 2,777,691 | 1/1957 | Malone | 272/33 R |
| 3,315,959 | 4/1967 | Carnielli | 272/72 |

FOREIGN PATENT DOCUMENTS

| | | | |
|---|---|---|---|
| 1081813 | 6/1954 | France | 272/33 R |

*Primary Examiner*—Richard C. Pinkham
*Assistant Examiner*—Arnold W. Kramer
*Attorney, Agent, or Firm*—Michael J. Striker

[57] ABSTRACT

A rotary conveyor, particularly a merry-go-round comprises a base which has an upright axis, a first rotatable member which is mounted on the base and rotates thereon about the upright axis, at least one support rigidly connected to the first member for rotation therewith. The support is operative to support a user. A second member is operatively connected to the support for rotating the first member in response to movements performed by the user.

16 Claims, 3 Drawing Figures

OCCUPANT PROPELLED ROTARY CONVEYOR

BACKGROUND OF THE INVENTION

The invention relates to a rotary conveyor.

More particularly, the present invention concerns a merry-go-round.

It is known in the art (See German Pat. No. 910,516 and German Offenlegungsschrift No. 2,138,130) to provide a merry-go-round with mechanical driving arrangements which are operated in response to the movement of a user sitting on a seat of such a merry-go-round. Such constructions usually include many different combinations of arms, levers, rods and other elements for transporting the force applied by the user onto handreels into rotation of arms rotatably mounted on a fixed base. To transform such movement into rotation, it is conventional to employ a disc or a gear fixedly connected with the arms.

Such a transforming arrangement proved to be subject to rapid wear; therefore, the very existence of these elements creates a danger for children playing with such a merry-go-round.

SUMMARY OF THE INVENTION

It is a general object of this invention to avoid the above-described disadvantages.

More particularly, it is an object of the invention to provide a reliable construction of a merry-go-round which will be completely safe in its utilization.

A further object is to provide a merry-go-round having a driving arrangement of a simple construction and which can be conveniently assembled and disassembled.

Another object of the present invention resides in providing such a merry-go-round which affords a user not only the pleasure of playing but also causes the user to perform exercises, e.g., in the manner well known in sports such as during rowing or riding.

Pursuant to these objects, and others which will become apparent hereafter, one feature of the present invention resides in providing a rotary conveyor, particularly a merry-go-round with a base having an upright axis, first means rotatably mounted on said base for rotation about said upright axis and at least one support rigidly connected to said first means for rotation therewith. The support is operative to support a movable load (i.e., a user). The conveyor is further provided with second means operatively connected to said support for rotating said first means in response to movement performed by the load, e.g., the user.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
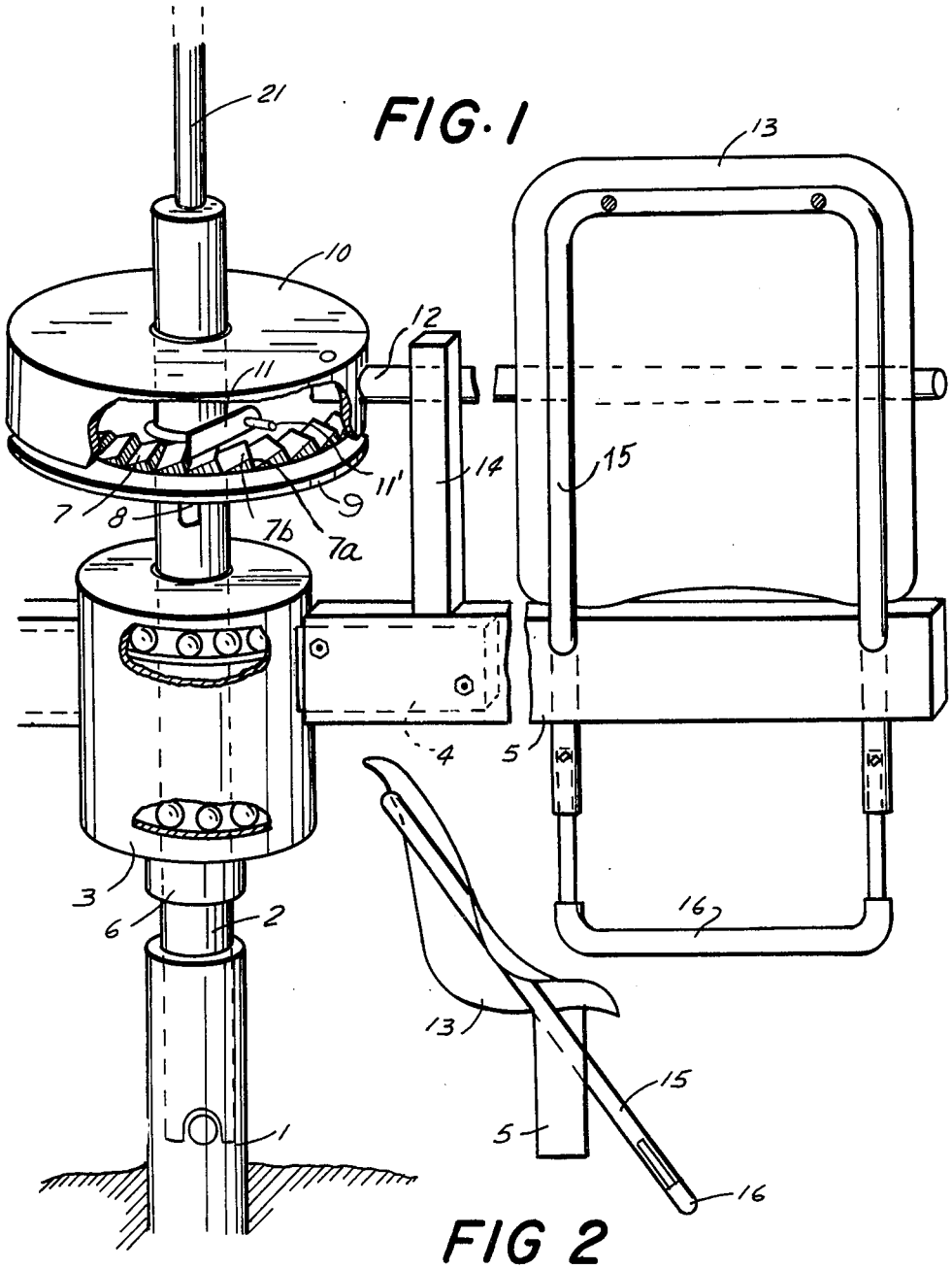
FIG. 1 is a partially sectioned fragmentary elevational view of a merry-go-round according to the present invention.
FIG. 2 is a side perspective of a seat of a merry-go-round in accordance with the present invention.

Referring now to the drawings and first to FIG. 1 thereof, it may be seen that the reference number 1 designates a tubular column which can be optionally mounted in the ground (shown) or on a base (not shown). A shaft 2 is fixedly located in the interior of the column 1. A thick-walled tubular element 3 is mounted on the shaft 2 and provided with the illustrated anti-friction bearings for taking up radial and axial loads. The element 3 is further provided with a plurality of supports 4 (e.g., two or more) fixedly mounted on the outer surface of the element 3. Each support 4 is operative for supporting an arm 5. The element 3 is further supported on a shoulder 6 of the shaft 2.

A ratchet with an annulus 7 of teeth is mounted on the shaft 2 above the element 3. The teeth 7 each have one steeply inclined flank *7a* and one gently inclined flank *7b*. The ratchet is fixedly mounted on the shaft 2 by a key 8, so that it can not rotate relative to the shaft 2. The ratchet is further provided with a projecting circumferential flange 9 which closely abuts against an inverted cup-shaped jacket 10. A pawl 11 is pivotably mounted on a pin 11' adjacent to the teeth 7 of the ratchet. Thus, the pawl 11 under the force of gravity falls into engagement with the respective teeth 7. The pawl 11 is free to so pivot in the interior of the jacket 10.

A handle 12 is mounted on the jacket 10. When the handle 12 is pulled towards a seat 13 mounted on the respective arm 5, the pawl 11 engages the flank *7a* of a corresponding tooth 7 of the annulus, thereby creating a force counter to that applied to the handle 12. Upon further applying the pulling force to the handle 12 in the same direction, a user sitting in the seat 13 rotates the arm 5 with the seat 13 about the shaft 2. The movements of the user are very similar to those of a rower sitting in a boat when rowing, in which case water serves to produce resitance to the force applied by the rower onto the oar. In the present invention this function is accomplished by the pawl 11 engaging with the respective flank *7a*. In further resemblance to the row action, where coupling of the water resistance is carried out through a seat of the boat on which the rower sits, coupling of the resistance in the case of the present invention is also carried out via the seat 13 in which the user sits.

In order to eliminate the possibility of overriding movement of the arm 5, which is likely to occur when a strong pulling force is applied to the handle 12, the arm 5 is provided with an end stop 14 which prevents the handle 12 from approaching the seat 13 beyond a predetermined distance. Due to this any possible damage (squeezing etc.) to the body of the user in seat 13 is eliminated. When force is applied to the handle 12 and the arm 5 in consequence rotates about shaft 2, the handle 12 moves in the same direction as the arm (due to being gripped by the user or due to abutting the abutment 14) and during this movement the pawl 11 idly slides over the teeth 7 of the ratchet. To continue rotation the user then has to push the handle 12 away from himself and to again pull it towards himself. The movements of the body of the user are similar to those exercised by a rower. No blocking or jamming of the driving elements can take place, even when the arrangement is operated in a random manner, as children may be want to do.

The seat 13 is mounted on a U-shaped frame 15 (see FIG. 2) and so fixedly installed on the arm 5, for example screwed on, as to insure a firm connection between the seat 13 and the arm 5. The lower open end of the frame 15 is provided with an adjustable foot support 16. The foot support 16 can be adjusted vertically along the frame 15 and arrested by e.g., screws in a selected position. The walls of the foot support may be provided with a rubber or plastic covering.

Figure 3:
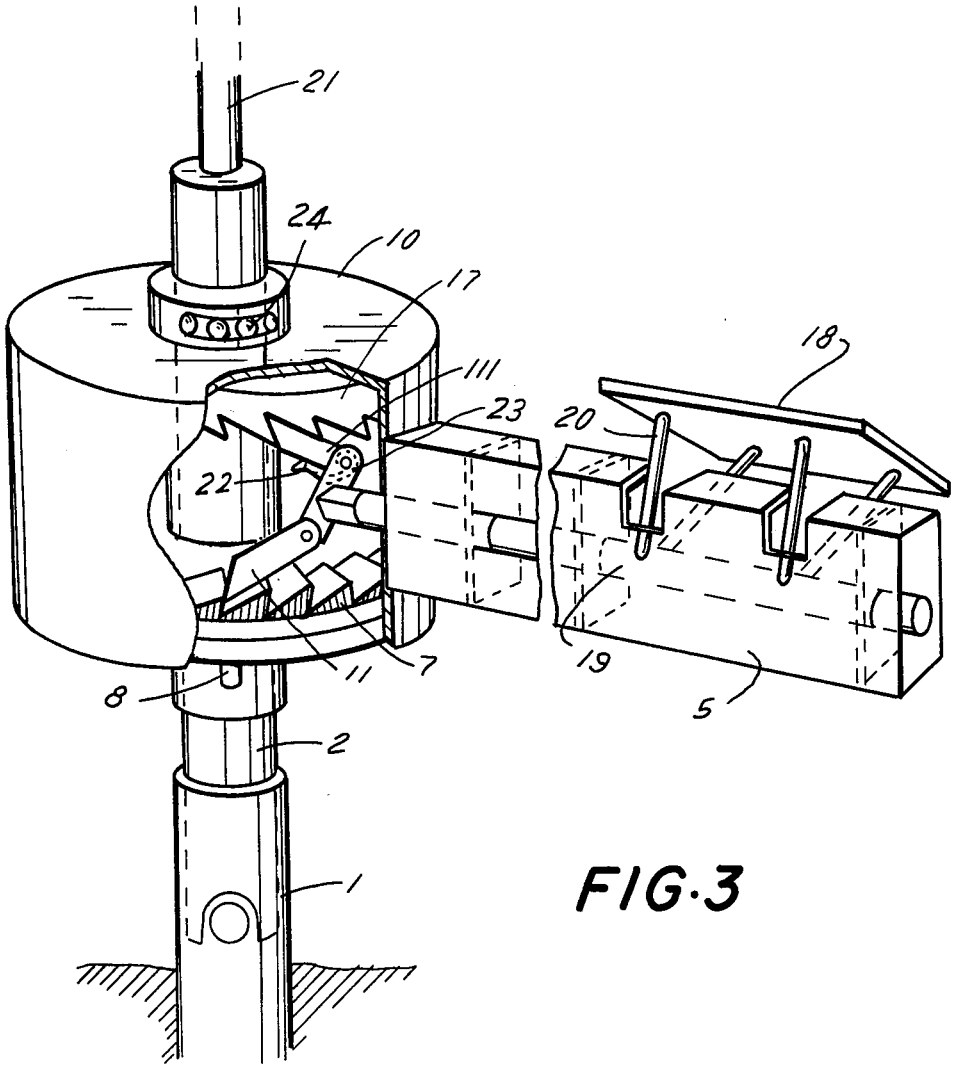
FIG. 3 is a partially sectioned fragmentary perspective view of another embodiment of the present invention.

FIG. 3 shows another embodiment of the present invention, where there is provided a double ratchet mechanism, which comprises a rocking lever with two pawls 11, 111. The upper pawl 111 is urged by a spring 22 to a position in which the pawl 111 engages the annulus of teeth of an upper ratchet 17, also rigidly mounted on the shaft 2. The arm 5 is provided with a throughgoing passage for receiving a rocking lever 19 therein.

The lever 19 during its rocking movement corresponding to the backwards movement of the upper pawl 111 along the teeth of the upper ratchet 17, generates a driving movement on the arm 5. Such an embodiment is employed in a merry-go-round shown in FIG. 3 and having a rockable seat 18. Instead of the handle 12 (FIG. 1) this embodiment is provided with the shaft 19, which is mounted within the hollow arm 5. The forward end of the lever 19 is fixedly connected with a rocking lever 23 which supports at one of its ends a lower pawl 11 and at the other of its ends the upper pawl 111. The rear end portion of the lever 19 is connected through rods 20 with the rockable seat 18. The rockable seat 18 moves the rods 20 and further the lever 19 which displaces the member 23 with two pawls 11 and 111 to and fro, so that by rocking the seat 18 in either direction rotation of the arm 5 will occur. The arm 5 is mounted on the jacket 10 which completely embraces the ratchets 7, 17 and pawls 11 and 111. The jacket 10 is further provided with an anti-friction bearing 24 and this replaces the element 3 of the first embodiment shown in FIG. 1. To operate the embodiment of FIG. 3 a user on seat 18 simply shifts his body weight to and fro on the seat to make the same tilt alternately in one and the opposite direction.

The tiltable seat 18 can be replaced by a slidable seat. In this case the seat will be mounted on the rails (not shown) and can be connected, e.g., via a wire, rope or any other similar connecting arrangement with the rods 20 to make the same tilt and cause the lever 19 to turn. In the embodiment of FIG. 3, it is the seat which carries out the functions of the handle 12 of the first embodiment. Here, also, the arrangement can turn only in one direction whereas turning in the opposite direction is blocked.

The hollow shaft 2 may have an open upper end into which the shaft 21 of an umbrella (not shown) may be inserted. This can be useful to protect the user against sun or rain. Movable metal parts of the arrangement, especially the pawls 11 and 111, may advantageously be provided with a sound proofing covering, or may be made of a low-noise material (e.g., nylon).

It will be understood that each of the elements described above, or two or more together, may also find a useful application in other types of rotary conveyors differing from the types described above.

While the invention has been illustrated and described as embodied in a rotary conveyor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rotary conveyor, particularly a merry-go-round, comprising a base having an upright axis; rotary means having bearing means rotatably mounted on said base for rotation about said axis, and an arm fixedly connected with said bearing means for joint rotation therewith;

support means having a support member which carries a seat for supporting a user and is detachably connectable with said arm of said rotary means for joint rotation about said axis; and rotating means for rotating said rotary means together with said support member and having a ratchet mechanism which includes a gear fixedly connected with said base and having a radially outwardly extending marginal portion, and a pawl engageable with and disengageable from said gear, said rotating means further including a lever having one end portion operatively connected with said ratchet mechanism, and another end portion which is subject to force applied thereto by a user, so that in engaged condition of said pawl said rotary means together with said support means can be rotated about said axis under the action of the force applied by the user to said lever, said rotating means also including a cup-shaped holding member which has a downwardly open end portion abutting against said marginal portion of said gear, and which holds said pawl so that the latter freely falls into engagement with said gear.

2. A conveyor as defined in claim 1, wherein said gear and said pawl holding member each have an axially extended through-going passage for receiving therethrough said base.

3. A conveyor as defined in claim 1, further comprising means for protecting said lever against undesired overrunning displacement when said force exceeds a predetermined maximum force.

4. A conveyor as defined in claim 3, wherein said protecting means comprise an end stop fixedly mounted on said arm and axially projecting therefrom in direction towards said lever so as to define a space between said lever and said end stop sufficient to permit said lever approach said end stop by a predetermined distance.

5. A conveyor as defined in claim 4, wherein said seat is provided with an arrangement for supporting the legs of a user sitting on said seat.

6. A conveyor as defined in claim 5, wherein said other end portion of the lever is adapted to support the hands of a user.

7. A conveyor as defined in claim 4, wherein said end stop is provided with a cover of sound proofing material.

8. A conveyor as defined in claim 1, wherein said seat is further provided with means for axially adjusting its position relative to said support member.

9. A conveyor as defined in claim 1, wherein said bearing means includes an anti-friction bearing element fixedly mounted on said base and a sleeve-shaped casing surrounding said bearing element and rotatably supported by the latter, said arm being fixedly connected to said sleeve-shaped casing so that the latter rotates with said arm and said seat in response to the force applied by the user to said lever.

10. A conveyor as defined in claim 9, wherein said arm has a first end portion fixedly connected to said casing and a second end portion detachably connected with said support member.

11. A conveyor as defined in claim 10, wherein said pawl is provided with a cover layer of sound-proofing material.

12. A conveyor as defined in claim 9, wherein said bearing means further includes a second such anti-friction bearing element, one of said bearing elements being operative for taking up radial loads whereas the other of said bearing elements is operative for taking axial loads.

13. A conveyor as defined in claim 1, wherein said base has an upper end adapted to mount an umbrella.

14. A conveyor as defined in claim 1, wherein said pawl holding member has a hole, said lever extending through said hole of said pawl holding member and being fixed thereto.

15. A conveyor as defined in claim 14; and further comprising means for fixing said lever to said pawl holding member and including a pin.

16. A conveyor as defined in claim 1, wherein said support member is elongated and has two through-going holes which are spaced from one another in a direction of elongation, said seat having a frame and a seat member, said frame including a first frame member which is bent in one plane and U-shaped and with which said seat member is connected, said first frame member having two elongated legs connected with one another at their one end and extending through said through-going holes of said support member, said frame further including a second frame member which is also bent and U-shaped and forms a support for the legs of a user, said second frame member being connected with said first frame member at another end of said legs, so that said two frame members together form an endless structure.

* * * * *